US006253051B1

(12) United States Patent
Iikura et al.

(10) Patent No.: US 6,253,051 B1
(45) Date of Patent: Jun. 26, 2001

(54) WET-TYPE IMAGE FORMING APPARATUS AND METHOD

(75) Inventors: Kazuaki Iikura; Takeshi Hirano, both of Niigata (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/484,726

(22) Filed: Jan. 18, 2000

(30) Foreign Application Priority Data

Jan. 18, 1999 (JP) ..... 11-009796
Feb. 12, 1999 (JP) ..... 11-034944

(51) Int. Cl.[7] ..... G03G 15/10
(52) U.S. Cl. ..... 399/249; 399/237
(58) Field of Search ..... 399/237, 249, 399/251; 347/126

(56) References Cited

U.S. PATENT DOCUMENTS 5,574,547 * 11/1996 Denton et al. ..... 399/251
5,933,689 * 8/1999 Kim ..... 399/237 X
5,940,666 8/1999 Han ..... 399/249
5,978,631 * 11/1999 Lee ..... 399/251
5,987,284 * 11/1999 Lewis ..... 399/249

FOREIGN PATENT DOCUMENTS 54-109450 * 8/1979 (JP) .
58-143362 8/1983 (JP) .
3-270507 12/1991 (JP) .
5-11566 1/1993 (JP) .
6-268696 9/1994 (JP) .
7-311503 11/1995 (JP) .
9-101683 4/1997 (JP) .
9-326837 12/1997 (JP) .
10154994 6/1998 (JP) .
11-38768 2/1999 (JP) .
11-73024 3/1999 (JP) .
11-88205 3/1999 (JP) .
11-308128 11/1999 (JP) .

OTHER PUBLICATIONS

Japanese Office Action issued Oct. 17, 2000 in a related application with English translation of relevant portions.
*Partial translation of Japanese Office Action dated Jul. 12, 2000, explaining relevance of JP11–73024 and JP10–154994.

* cited by examiner

*Primary Examiner*—Sophia S. Chen
(74) *Attorney, Agent, or Firm*—Ostrolenk, Faber, Gerb & Soffen, LLP

(57) ABSTRACT

A wet-type image forming apparatus which allows excess solvent to be effectively removed from the developed image is disclosed. A developing roller develops a latent image on the photoconductor member using the liquid developer composed of toner particles and a solvent. A squeezing roller squeezes excess solvent from a surface of a photoconductor member. A heater heats liquid developer existing on the photoconductor member to a temperature at which the solvent of the liquid developer is prone to vaporize. The heater is provided in one of the developing roller, the squeezing roller, and the liquid developer reservoir.

10 Claims, 3 Drawing Sheets

WET-TYPE IMAGE FORMING APPARATUS

WET-TYPE IMAGE FORMING APPARATUS AND METHOD

BACKGROUND OF THE INVENTION

1. Field of the Invention

The present invention relates to an image forming apparatus using electrophotographic technique and relates in particular to an apparatus and method for forming an image using liquid developer composed of toner particles and solvent.

2. Description of the Related Art

There have been proposed wet-type image forming apparatuses having a heating means which is used in the developing process of the electrophotography to improve the quality of image.

In Japanese Patent Application Laid-open No. HEI 5-11566, an image forming apparatus is disclosed which is provided with a preheating roller located downstream from the developing unit and upstream from the transfer unit. The preheating roller is used to vaporize the solvent included in the developed image, which will causes the developed image to be prevented from spreading, resulting in improved quality of image.

However, excess solvent remains in the developed image from the developing unit to the preheating roller. Therefore, the excess solvent is likely to cause the spreading of the developed image, resulting in reduced quality of image. Further, it is necessary to provide space for the preheating roller. Therefore, the structure becomes complicated and its size becomes larger.

In Japanese Patent Application Laid-open No. SHO 58-143362, a squeezing apparatus is disclosed which is provided with a squeezing roller having a heater therein. Heating the squeezing roller to an appropriate temperature causes the viscosity of liquid developer to be reduced, resulting in improved effectiveness of squeeze.

In Japanese Patent Application Laid-open No. HEI 9-101683, a wet-type electrophotographic copying machine is disclosed which is provided with a developing unit having a heating element therein. The heating element heats the liquid developer to an appropriate temperature ranging from 50 to 60 degrees Celsius to prevent the toner particles of the liquid developer from agglomerating.

However, neither the squeezing roller having a heater therein nor the developing unit having a heating element therein as described above provides a means for effectively removing excess solvent from the developed image. Therefore, the excess solvent is likely to cause the spreading of the developed image, resulting in reduced quality of image.

SUMMARY OF THE INVENTION

An object of the present invention, which has been developed in view of the problems of the prior art described above, is to provide a wet-type image forming apparatus and method which allow the quality of image to be improved without increasing in complexity and size.

Another object of the present invention is to provide a wet-type image forming apparatus and method which allow excess solvent to be effectively removed from the developed image.

According to the present invention, a wet-type image forming apparatus for forming an image on a photoconductor member using liquid developer which is composed of toner particles and a solvent, comprises a developing section for developing a latent image on the photoconductor member using the liquid developer stored therein; a squeezing section for squeezing excess solvent from a surface of the photoconductor member; and a heater for heating liquid developer existing on the photoconductor member to a temperature at which the solvent of the liquid developer is prone to vaporize, wherein the heater is provided in one of the developing section and the squeezing section.

According to an aspect of the present invention, a wet-type image forming apparatus for forming an image on a photoconductor member using liquid developer which is composed of toner particles and a solvent, comprises:

- a charging section for charging a surface of the photoconductor member;
- a latent image forming section for forming a latent image on the photoconductor member;
- a developing roller for developing the latent image on the photoconductor member using the liquid developer stored in a reservoir;
- a squeezing roller for squeezing excess solvent from the surface of the photoconductor member; and
- a heater for heating liquid developer existing on the photoconductor member to a temperature at which the solvent of the liquid developer is prone to vaporize, wherein the heater is provided in one of the developing roller, the reservoir, and the squeezing roller.

According to another aspect of the present invention, a wet-type image forming apparatus for forming an image on a photoconductor belt using liquid developer which is composed of toner particles and a solvent, comprises:

- a charging section for charging a surface of the photoconductor belt;
- a latent image forming section for forming a latent image on the photoconductor belt;
- a developing roller for developing the latent image on the photoconductor belt using the liquid developer stored in a reservoir;
- a squeezing roller for squeezing excess solvent from the surface of the photoconductor belt; and
- a backup roller opposite to the squeezing roller via the photoconductor belt, for putting a predetermined magnitude of pressure to the squeezing roller and heating liquid developer existing on the photoconductor member to a temperature at which the solvent of the liquid developer is prone to vaporize.

The backup roller may have a heater provided in a hollow thereof such that a periphery of the backup roller is uniformly heated. Alternatively, the backup roller may be made of a material having a predetermined amount of resistance so that the backup roller itself is heated.

The heater heats the liquid developer existing on the photoconductor member to a temperature which is lower than a boiling point of the liquid developer.

The backup roller heats the liquid developer existing on the photoconductor member to a temperature which is lower than a boiling point of the liquid developer.

The heater heats the periphery of the squeezing roller to a temperature which is not lower than a boiling point of the liquid developer.

The backup roller heats a periphery of the squeezing roller to a temperature which is not lower than a boiling point of the liquid developer.

DESCRIPTION OF THE PREFERRED EMBODIMENTS

FIRST EMBODIMENT

Figure 1:
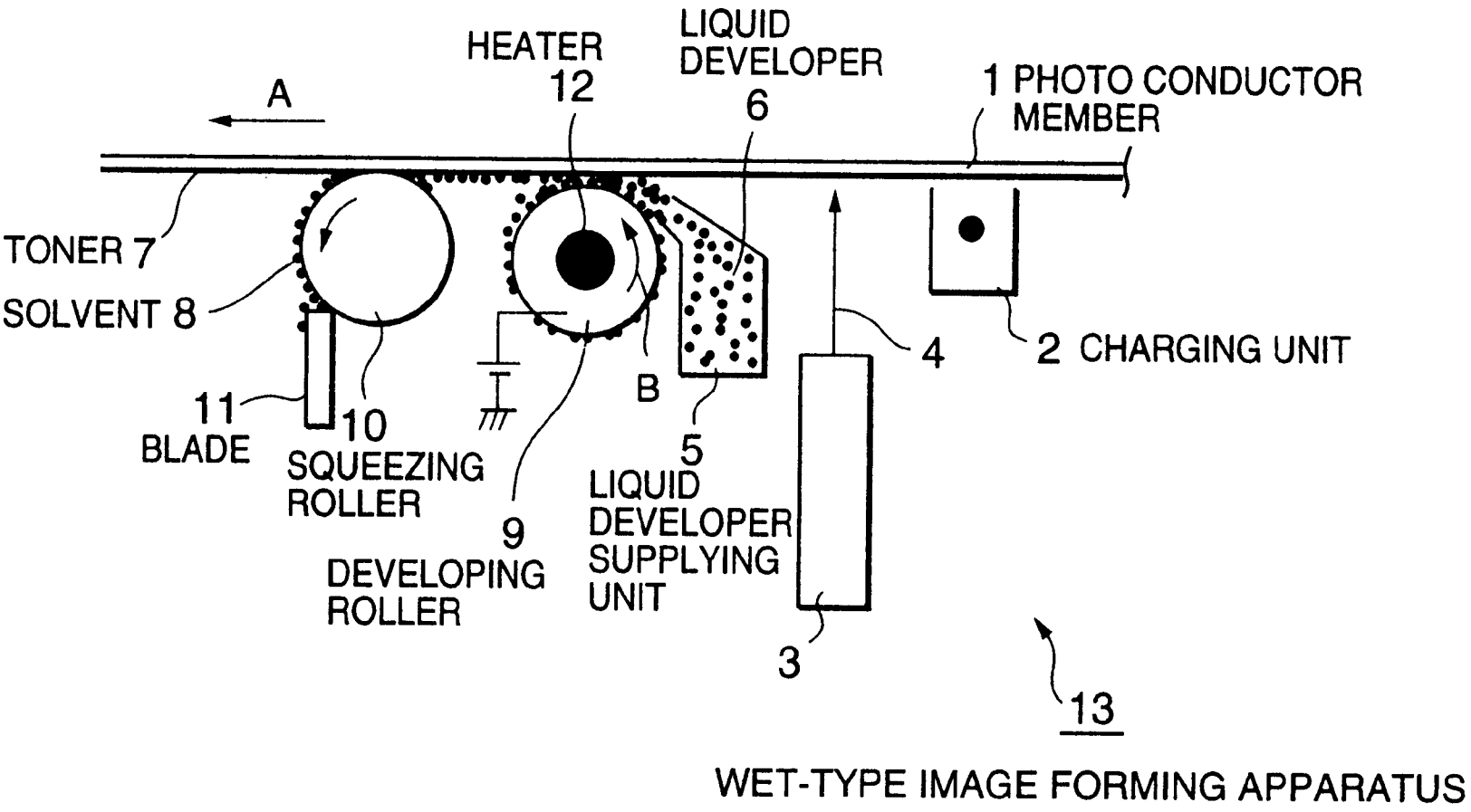
FIG. 1 is a diagram showing a schematic structure of a wet-type image forming apparatus according to a first embodiment of the present invention.

Referring to FIG. 1, a wet-type image forming apparatus, shown generally as 13 according to a first embodiment of the present invention uses a belt-shaped photoconductor member 1 which moves in the direction shown by an arrow A. Members involved in exposure and development processes face to the outside surface of the photoconductor member 1.

More specifically, a charging unit 2 is provided to electrostatically charge the outside surface of the photoconductor member 1 to a predetermined potential. A light source 3 is provided downstream from the charging unit 2 and emits a light beam 4 modulated according to image data to the outside surface of the photoconductor member 1, so that a point exposed to the light beam 4 reduces in potential and thereby a latent image is formed on the outside surface of the photoconductor member 1.

A liquid developer supplying unit 5 stores liquid developer 6 containing a positively charged toner 7 and a solvent (carrier) 8, which mixture will be referred to as "inks". The liquid developer 6 is supplied to a developing roller 9 which is provided downstream from the light source 3 with facing to the outside surface of the photoconductor member 1. A predetermined voltage is applied to the developing roller 9 so that a potential difference is generated between the developing roller 9 and the photoconductor member 1. The potential difference causes toner particles in the liquid developer 9 to move from the developing roller 9 to the outside surface of the photoconductor member 1, so that the latent image is developed by the toner of the liquid developer supplied from the developing roller 9 rotating in the direction as shown by an arrow B.

A squeezing roller 10 is supported at a position downstream from the developing roller 9. The squeezing roller 10 removes excess solvent 8 from the liquid developer on the photoconductor member 1. The solvent 8 and other things on the squeezing roller 10 are scrapped by a blade 11 which is in contact with the periphery of the squeezing roller 10.

According to the first embodiment, the developing roller 9 has a heater 12 therein. More specifically, the developing roller 9 has a hollow therein and the heater 12 is placed in the hollow so as to uniformly heat the whole periphery of the developing roller 9 to a temperature lower than a boiling point of the liquid developer. The length of the heater 12 is approximately equal to that of the developing roller 9. In other words, the heater 12 is used to heat the surface of the developing roller 9 so that the liquid developer 6 on the developing roller 9 is heated to a temperature at which the solvent is prone to vaporize. The heated liquid developer 6 is supplied to the outside surface of the photoconductor member 1 and develops the latent image on the outside surface of the photoconductor member 1. Since the liquid developer 6 on the outside surface of the photoconductor member 1 is heated to the extent that the solvent is prone to vaporize, the vaporization of solvent is accelerated. Therefore, a combination of the vaporization caused by the heater 12 and the squeeze operation performed by the squeezing roller 10 efficiently removes excess solvent from both the photoconductor member 1 and the developed toner image formed on the photoconductor member 1. In this way, the toner image on the photoconductor member 1 from which excess solvent has been removed is transferred from the photoconductor member 1 to a recording medium such as a paper.

The developing roller 9 is preferably made of a material having electrical conductivity and heat resistance such as a metal. Stainless steel is suitable for material of the developing roller 9. Aluminum, copper, iron, and the like may be used because such a material has a low thermal expansion coefficient and is easy to perform surface treatment of a workpiece.

The heater 12 may be a heating lamp such as a halogen lamp or a heating element made of a high-resistance material such as Nichromeυ. It is necessary to keep the temperature of the periphery of the developing roller 9 at a temperature lower than the boiling point of the liquid developer. If the temperature of the periphery of the developing roller 9 is heated to a temperature equal to or higher than the boiling point of the liquid developer, toner particles of the liquid developer 9 become agglomerate on the periphery of the developing roller 9.

The squeezing roller 10 is preferably made of fine foam rubber. Natural rubber or synthetic rubber may be used as a material of the fine foam rubber. Especially, organohalide elastomer is most preferably used because of high intermolecular bond energy and high solvent-resistance. The blade 11 is preferably shaped like a plate and the material thereof may be metal, resin, rubber or the like.

As described above, the liquid developer 6 on the outside surface of the photoconductor member 1 is heated to a temperature equal to or higher than the boiling point of the liquid developer. Therefore, the solvent of the liquid developer is prone to vaporize and thereby the time required for agglomerating toner particles on the photoconductor member 1 is reduced. As a result, the spreading and deviation of the developed image can be avoided and the high quality of image can be obtained. Further, since the heater 12 is placed within the developing roller 9, the space for vaporization of solvent is not needed, resulting in reduced size of the wet-type image formation apparatus.

For example, in the case of an ink having a boiling point of about 70 degrees Celsius, which is composed of hydrocarbon (toner) and a paraffin-base solvent such as normal paraffin or isoparaffin, the heater 12 is controlled such that the temperature of the periphery of the developing roller 9 is kept at a temperature higher than 50 degrees Celsius and lower than the boiling point of the liquid developer 6. Preferably, the temperature of the periphery of the developing roller 9 is kept at a temperature ranging from 50 to 60 degrees Celsius. More preferably, the temperature is set to a range of 60±5 degrees Celsius.

SECOND EMBODIMENT

Figure 2:
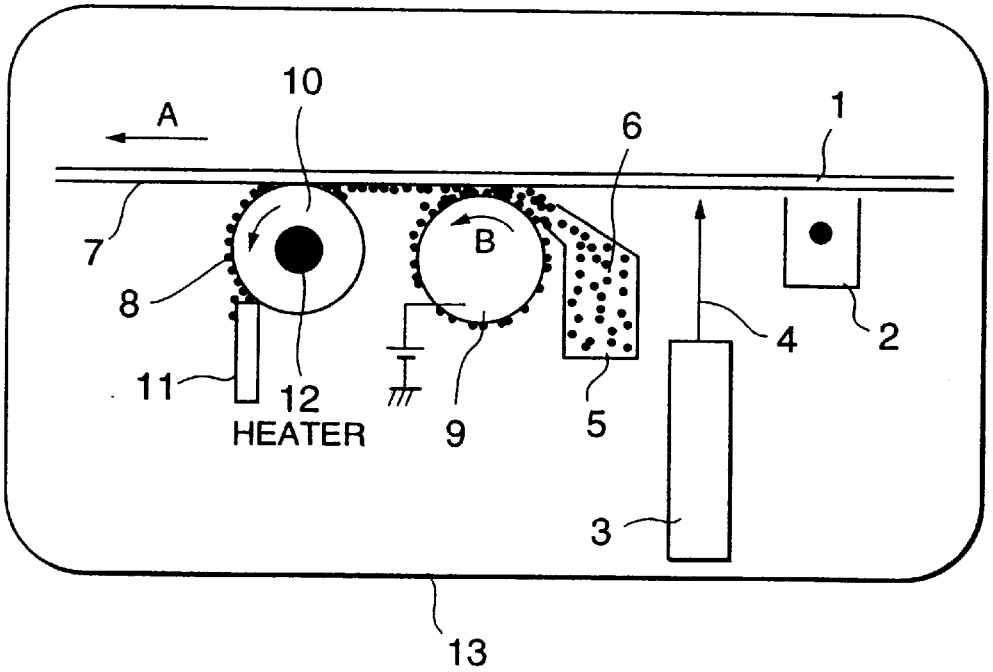
FIG. 2 is a diagram showing a schematic structure of a wet-type image forming apparatus according to a second embodiment of the present invention.

Referring to FIG. 2, a wet-type image forming apparatus, shown generally as 13, according to a second embodiment of the present invention has a heater 12 provided within the squeezing roller 10. Members similar to those previously described with reference to FIG. 1 are denoted by the same reference numerals and the details thereof are omitted.

More specifically, the squeezing roller 10 has a hollow therein and the heater 12 is placed in the hollow so as to uniformly heat the whole periphery of the squeezing roller 10 to a temperature lower than a boiling point of the liquid developer. The length of the heater 12 is approximately equal to that of the squeezing roller 10. The squeezing roller 10 removes excess solvent from the surface of the photoconductor member 1 and further heats the surface of the photoconductor member 1 so that the remaining solvent on the photoconductor member 1 is heated to a temperature at which the solvent is prone to vaporize. It is preferable that the surface temperature of the squeezing roller 10 does not exceed the boiling point of the liquid developer 6. It may exceed the boiling point of the liquid developer 6 without adversely influencing the quality of image. In the case where the concentration of vaporized solvent becomes high within the apparatus, consideration must be given to exhaust.

Accroding to the second embodiment, a combination of the vaporization caused by the heater 12 and the squeeze operation performed by the squeezing roller 10 efficiently removes excess solvent from both the photoconductor member 1 and the developed toner image formed on the photoconductor member 1. In this way, the toner image on the photoconductor member 1 from which excess solvent has been removed is transferred from the photoconductor member 1 to a recording medium such as a paper. It is apparent that the same advantages as the first embodiment are obtained.

For example, in the case of an ink having a boiling point of about 70 degrees Celsius, which is composed of hydrocarbon (toner) and a paraffin-base solvent such as normal paraffin or isoparaffin, the heater 12 is controlled such that the temperature of the periphery of the squeezing roller 10 is kept at a temperature higher than 50 degrees Celsius and lower than the boiling point of the liquid developer 6. Preferably, the temperature of the periphery of the squeezing roller 10 is kept at a temperature ranging from 50 to 60 degrees Celsius. More preferably, the temperature is set to a range of 60±5 degrees Celsius.

THIRD EMBODIMENT

Figure 3:
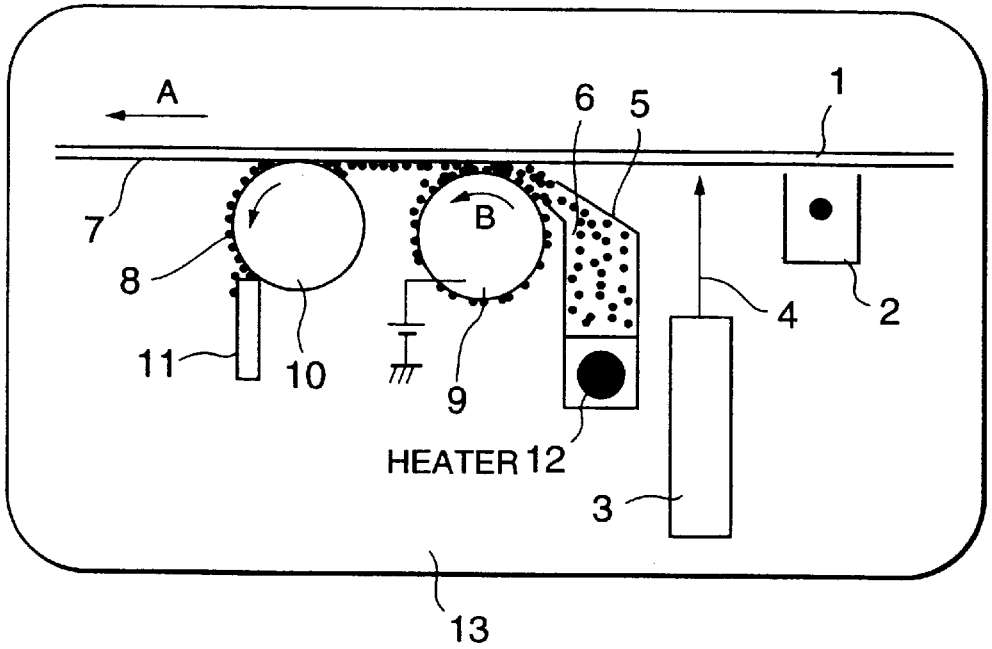
FIG. 3 is a diagram showing a schematic structure of a wet-type image forming apparatus according to a third embodiment of the present invention.

Referring to FIG. 3, a wet-type image forming apparatus, shown generally as 13, according to a third embodiment of the present invention has a heater 12 provided in the bottom portion of the liquid developer supplying unit 5. Members similar to those previously described with reference to FIG. 1 are denoted by the same reference numerals and the details thereof are omitted.

More specifically, the liquid developer supplying unit 5 has the heater 12 on the bottom of the liquid developer reservoir so that the liquid developer 6 is uniformly heated to a temperature lower than a boiling point thereof. The length of the heater 12 is approximately equal to that of the liquid developer reservoir. The liquid developer supplying unit 5 is preferably made of a heat-resistant metal. The heated liquid developer 6 is supplied to the developing roller 9 and then develops the latent image on the photoconductor member 1. Therefore, the squeezing roller 10 removes excess solvent from the surface of the photoconductor member 1 and further the remaining solvent on the photoconductor member 1 is likely to vaporize. It is necessary for the temperature of the liquid developer 6 not to exceed the boiling point thereof. If the liquid developer 6 is heated to a temperature equal to or higher than the boiling point of the liquid developer, toner particles of the liquid developer 9 become agglomerate on the periphery of the developing roller 9.

According to the third embodiment, a combination of the vaporization caused by the heater 12 and the squeeze operation performed by the squeezing roller 10 efficiently removes excess solvent from both the photoconductor member 1 and the developed toner image formed on the photoconductor member 1. In this way, the toner image on the photoconductor member 1 from which excess solvent has been removed is transferred from the photoconductor member 1 to a recording medium such as a paper. It is apparent that the same advantages as the first embodiment are obtained.

For example, in the case of an ink having a boiling point of about 70 degrees Celsius, which is composed of hydrocarbon (toner) and a paraffin-base solvent such as normal paraffin or isoparaffin, the heater 12 is controlled such that the temperature of the liquid developer 6 in the liquid developer supplying unit 5 is kept at a temperature higher than 50 degrees Celsius and lower than the boiling point of the liquid developer 6. Preferably, the temperature of the liquid developer 6 in the liquid developer supplying unit 5 is kept at a temperature ranging from 50 to 60 degrees Celsius. More preferably, the temperature is set to a range of 60±5 degrees Celsius.

FOURTH EMBODIMENT

Figure 4:
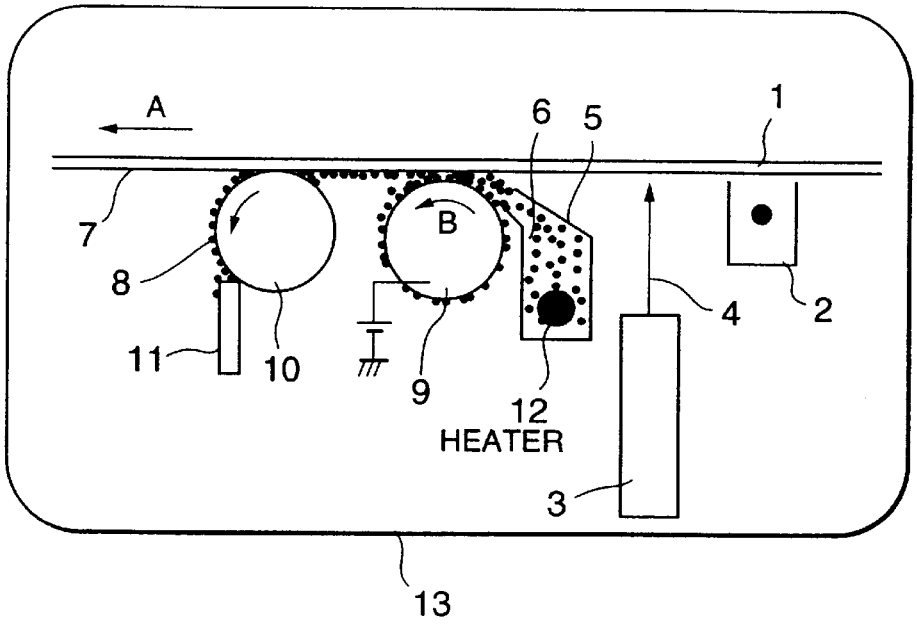
FIG. 4 is a diagram showing a schematic structure of a wet-type image forming apparatus according to a fourth embodiment of the present invention.

Referring to FIG. 4, a wet-type image forming apparatus, shown generally as 13, according to a fourth embodiment of the present invention has a heater 12 provided within a liquid developer reservoir of the liquid developer supplying unit 5. Members similar to those previously described with reference to FIG. 1 are denoted by the same reference numerals and the details thereof are omitted.

More specifically, the liquid developer supplying unit 5 has the heater 12 in the liquid developer reservoir so that the liquid developer 6 is directly in contact with the heater 12 and is heated to a temperature lower than a boiling point thereof. The length of the heater 12 is approximately equal to that of the liquid developer reservoir. The liquid developer supplying unit 5 is preferably made of a heat-resistant metal. The heated liquid developer 6 is supplied to the developing roller 9 and then develops the latent image on the photoconductor member 1. Therefore, the squeezing roller 10 removes excess solvent from the surface of the photoconductor member 1 and further the remaining solvent on the photoconductor member 1 is likely to vaporize. It is necessary for the temperature of the liquid developer 6 not to exceed the boiling point thereof. If the liquid developer 6 is heated to a temperature equal to or higher than the boiling point of the liquid developer, toner particles of the liquid developer 9 become agglomerate on the periphery of the developing roller 9.

According to the third embodiment, a combination of the vaporization caused by the heater 12 and the squeeze operation performed by the squeezing roller 10 efficiently removes excess solvent from both the photoconductor member 1 and the developed toner image formed on the photoconductor member 1. In this way, the toner image on the photoconductor member 1 from which excess solvent has been removed is transferred from the photoconductor member 1 to a recording medium such as a paper. It is apparent that the same advantages as the first embodiment are obtained.

For example, in the case of an ink having a boiling point of about 70 degrees Celsius, which is composed of hydrocarbon (toner) and a paraffin-base solvent such as normal paraffin or isoparaffin, the heater 12 is controlled such that the temperature of the liquid developer 6 in the liquid developer supplying unit 5 is kept at a temperature higher than 50 degrees Celsius and lower than the boiling point of the liquid developer 6. Preferably, the temperature of the periphery of the squeezing roller 10 is kept at a temperature ranging from 50 to 60 degrees Celsius. More preferably, the temperature is set to a range of 60±5 degrees Celsius.

In the first to fourth embodiments as described above, a combination of a single developing roller 9 and a single squeezing roller 10 is taken as an example. The present invention is not limited to these embodiments. In the case where a plurality of developing rollers and squeezing rollers for different liquid developers (for example, a color image forming apparatus), a plurality of heaters are provided respectively for the liquid developers and each heater is controlled depending on the characteristic of each liquid developer.

In the first to fifth embodiments, further, the photoconductor is shaped like a belt. The present invention can be applied to a photoconductor shaped like a drum.

Furthermore, in the case of a photoconductor belt, a backup roller may be provided for the squeezing roller 10. An appropriate pressure generated by the backup roller improves the squeezing effect. The heater 12 may be provided within such a backup roller as described hereafter.

FIFTH EMBODIMENT

Figure 5:
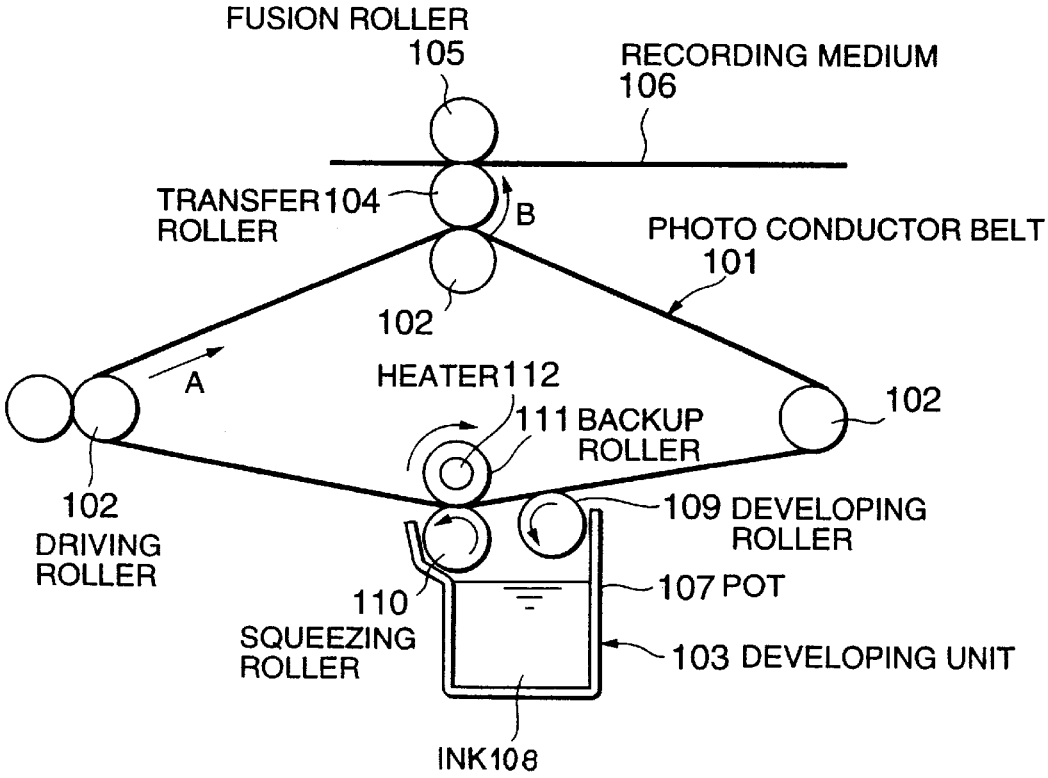
FIG. 5 is a diagram showing a schematic structure of a wet-type image forming apparatus according to a fifth embodiment of the present invention.

Referring to FIG. 5, a wet-type image forming apparatus according to a fifth embodiment of the present invention uses a photoconductor belt 101 which rotates depending on rotation of driving rollers 102 in the direction shown by an arrow A. Members involved in exposure, development, and transfer processes face to the outside surface of the photoconductor belt 101. Since these processes are described above, the details will be simplified or omitted.

More specifically, a developing unit 103 develops a latent image which has been formed on the photoconductor belt 101 by a charging unit (not shown in FIG. 5). The developed image on the photoconductor belt 101 is transferred to a recording medium 106 by means of transfer roller 104 and a fusion roller 105.

The developing unit 103 includes a pot 107 storing ink 108 composed of toner particles and solvent. The ink 108 is supplied to a developing roller 109, which develops the latent image using the toner of the liquid developer. A combination of a squeezing roller 110 and a backup roller 111 is supported at a position downstream from the developing roller 109.

The backup roller 111 has a heater 112 in a hollow formed therein. The back up roller 111 is provided with a pressurizing means such as a spring (not shown) to put pressure to the squeezing roller 110. Therefore, by energizing the heater 112 of the backup roller 111, the squeezing roller 110 efficiently removes excess solvent from the ink of the developed image on the photoconductor belt 101 sandwiched between the squeezing roller 110 and the backup roller 111 at a predetermined pressure and a predetermined high temperature.

Alternatively, the backup roller 111 may be made of a material having a predetermined amount of resistance. When a current flows through the backup roller 111, the backup roller 111 can be heated to a desired temperature.

The heater 112 may be a heating lamp such as a halogen lamp or a heating element made of a high-resistance material such as Nichrome™. It is necessary to keep the ink 108 of the developed image on the photoconductor belt 101 at a temperature lower than the boiling point of the ink 108. If the ink of the developed image on the photoconductor belt 101 is heated to a temperature equal to or higher than the boiling point of the ink 108, toner particles of the ink 108 become agglomerate on the periphery of the squeezing roller 110.

Since the photoconductor belt 101 is sandwiched at the predetermined pressure and predetermined high temperature between the squeezing roller 110 and the backup roller 111, the excess solvent of the developed image and the remaining solvent on the photoconductor belt 101 are effectively removed. In this way, the toner image on the photoconductor belt 101 from which excess solvent has been removed is transferred from the photoconductor belt 101 to the transfer roller 104 and then to the recording medium 106 such as a paper. Since the fusion roller 105 has a heater (not shown) therein, the remaining solvent of the developed image is completely removed and the toner image is transferred to the recording medium 106, resulting in improved quality of image.

According to the fifth embodiment, a combination of the vaporization caused by the heater 112 and the squeeze operation performed by the squeezing roller 110 efficiently removes excess solvent from both the photoconductor belt 101 and the developed toner image formed on the photoconductor belt 101. It is apparent that the same advantages as the first embodiment are obtained.

For example, in the case of an ink having a boiling point of about 70 degrees Celsius, which is composed of hydrocarbon (toner) and a paraffin-base solvent such as normal paraffin or isoparaffin, the heater 112 is controlled such that the surface temperature of the photoconductor belt 101 is kept at a temperature higher than 50 degrees Celsius and lower than the boiling point of the ink 108. Preferably, the temperature is kept at a temperature ranging from 50 to 60 degrees Celsius. More preferably, the temperature is set to a range of 60±5 degrees Celsius.

As described above, according to the first to fifth embodiments, the liquid developer or the ink of a developed image on the photoconductor is heated to the extent that the solvent is prone to vaporize. Therefore, excess solvent of the ink of the developed image can be efficiently removed without the need of pressing the squeezing roller to the photoconductor at a large pressure, resulting in improved quality and stability of image.

What is claimed is:

1. A wet-type image forming apparatus for forming an image on a photoconductor member using liquid developer which is composed of toner particles and a solvent, comprising:

a charging section for charging a surface of the photoconductor member;

a latent image forming section for forming a latent image on the photoconductor member;

a developing roller for developing the latent image on the photoconductor member using the liquid developer stored in a reservoir;

a squeezing roller for squeezing excess solvent from the surface of the photoconductor member; and a heater for heating liquid developer existing on the photoconductor member to a temperature at which the solvent of the liquid developer is prone to vaporize, wherein the heater is provided in at least one hollow in at least one of the developing roller and the squeezing roller such that a periphery of one of the developing roller and squeezing roller is uniformly heated;

wherein the heater heats the periphery of the squeezing roller to a temperature which is not lower than a boiling point of the liquid developer.

2. A wet-type image forming apparatus according to claim 1, wherein at least a second heater is provided on the bottom of the reservoir such that the liquid developer stored in the reservoir is uniformly heated.

3. The wet-type image forming apparatus according to claim 2, wherein at least one of the heaters heats the liquid developer existing on the photoconductor member to a temperature which is lower than a boiling point of the liquid developer.

4. The wet-type image forming apparatus according to claim 1, wherein at least a second heater is provided inside the reservoir such that the liquid developer stored in the reservoir is uniformly heated.

5. A wet-type image forming apparatus for forming an image on a photoconductor belt using liquid developer which is composed of toner particles and a solvent, comprising:

a charging section for charging a surface of the photoconductor belt;

a latent image forming section for forming a latent image on the photoconductor belt;

a developing roller for developing the latent image on the photoconductor belt using the liquid developer stored in a reservoir;

a squeezing roller for squeezing excess solvent from the surface of the photoconductor belt; and a backup roller opposite to the squeezing roller via the photoconductor belt, for putting a predetermined magnitude of pressure to the squeezing roller and heating liquid developer existing on the photoconductor belt to a temperature at which the solvent of the liquid developer is prone to vaporize;

wherein the backup roller has a heater provided in a hollow thereof such that a periphery of the backup roller is uniformly heated; and wherein the heater heats a periphery of the squeezing roller to a temperature which is not lower than a boiling point of the liquid developer.

6. The wet-type image forming apparatus according to claim 5, wherein the heater heats the liquid developer existing on the photoconductor belt to a temperature which is lower than a boiling point of the liquid developer.

7. A wet-type image forming apparatus for forming an image on a photoconductor belt using liquid developer which is composed of toner particles and a solvent, comprising:

a charging section for charging a surface of the photoconductor belt;

a latent image forming section for forming a latent image on the photoconductor belt;

a developing roller for developing the latent image on the photoconductor belt using the liquid developer stored in a reservoir;

a squeezing roller for squeezing excess solvent from the surface of the photoconductor belt; and a backup roller opposite to the squeezing roller via the photoconductor belt, for putting a predetermined magnitude of pressure to the squeezing roller and heating liquid developer existing on the photoconductor belt to a temperature at which the solvent of the liquid developer is prone to vaporize;

wherein the backup roller is made of a material having a predetermined amount of resistance so that when an electric current is applied to the backup roller, the backup roller itself is heated; and wherein the backup roller heats a periphery of the squeezing roller to a temperature which is not lower than a boiling point of the liquid developer.

8. The wet-type image forming apparatus according to claim 7, wherein the backup roller heats the liquid developer existing on the photoconductor belt to a temperature which is lower than a boiling point of the liquid developer.

9. A wet-type image forming method for forming an image on a photoconductor member using liquid developer which is composed of toner particles and a solvent, comprising the steps of:

developing a latent image on the photoconductor member using the liquid developer stored therein in conjunction with a developing roller;

squeezing excess solvent from a surface of the photoconductor member with a squeezing roller;

heating liquid developer existing on the photoconductor member with a heater provided in a hollow in one of the developing roller and the squeezing roller such that a periphery of one of the developing roller and squeezing roller is uniformly heated to a temperature at which the solvent of the liquid developer is prone to vaporize.

10. The wet-type image forming method according to claim 9, wherein the liquid developer existing on the photoconductor member is heated to a temperature which is lower than a boiling point of the liquid developer.

* * * * *